US007197785B2

(12) United States Patent
Lin

(10) Patent No.: US 7,197,785 B2
(45) Date of Patent: Apr. 3, 2007

(54) CONNECTING ASSEMBLY FOR SWEEPING AND WRINGING APPARATUS

(76) Inventor: Ming-Hsien Lin, No. 13, Hun Yi St., Pu Tzi Chen Ind Dist, Chia Yi Hsien (TW)

( * ) Notice: Subject to any disclaimer, the term of this patent is extended or adjusted under 35 U.S.C. 154(b) by 0 days.

(21) Appl. No.: 11/113,369

(22) Filed: Apr. 23, 2005

(65) Prior Publication Data

US 2006/0236481 A1 Oct. 26, 2006

(51) Int. Cl.
*A47L 13/144* (2006.01)

(52) U.S. Cl. ..... 15/119.2

(58) Field of Classification Search ..... 15/116.1, 15/116.2, 119.1, 119.2
See application file for complete search history.

(56) References Cited

U.S. PATENT DOCUMENTS 2,210,944 A * 8/1940 McMullin ..... 15/119.1
2,651,069 A * 9/1953 Hoffman ..... 15/119.2
2,852,794 A * 9/1958 Blum ..... 15/119.2
5,097,561 A * 3/1992 Torres ..... 15/119.2
5,528,791 A * 6/1996 Wilson ..... 15/119.2
6,341,401 B1 * 1/2002 Lin ..... 15/119.2

* cited by examiner

*Primary Examiner*—Mark Spisich
(74) *Attorney, Agent, or Firm*—Pro-Techtor Int'l Services

(57) ABSTRACT

A connecting assembly for a sweeping and wringing apparatus is used in conjunction with a sweeping and wringing apparatus having a cleaning head, a main rod and a U-shaped wringing rod and comprises a connecting rod, having an upper end that is hingedly connected with the U-shaped wringing rod and a lower end reaching down inside the main rod, and a connecting part, having an upper end with a joint that is hingedly connected with the lower end of the connecting rod, an extended middle part and a fixing part that is fastened to the cleaning head, so that assembling and replacing of the cleaning head are facilitated and damaging of furniture during sweeping is avoided.

3 Claims, 10 Drawing Sheets

CONNECTING ASSEMBLY FOR SWEEPING AND WRINGING APPARATUS

BACKGROUND OF THE INVENTION

1. Field of the Invention

The present invention relates to a connecting assembly for a sweeping and wringing apparatus, particularly to a connecting assembly for a sweeping and wringing apparatus driving a wringing movement of a cleaning element and accommodated within a main rod, thereby being easy to mount and replace and avoiding damaging of furniture during floor sweeping.

2. Description of Related Art

As shown in FIGS. 12 and 13, a conventional sweeping and wringing apparatus comprises: a cleaning head 1, a squeezing head 2, a main rod 3, a U-shaped wringing rod 4, two connecting rods 5, two transverse bars 56, and squeezers 57. The cleaning head 1 has a base plate 11 and a cleaning element 12 and is used for sweeping a floor. The squeezing head 2 is placed on an upper side of the cleaning head 1, partly surrounding the cleaning head 1 in the shape of the inverted letter U, and has an upper part, having a fasten hole 21 and two sides with openings 22, and downward extending front and rear parts, each of which have a left arm 23 and a right arm 24 further extending downward, enclosing an opening 27. Through holes 25, 26 are bored through the left and right arms 23, 24, respectively. The main rod 3 is mounted on the fasting hole 21 of the squeezing head 2 and serves as a hold during sweeping. The wringing rod 4 is on two ends thereof hingedly connected with the main rod 3 at a middle section thereof and has an outward-reaching middle section with a grip 41, facilitating pulling up of the wringing rod 4. The two connecting rods 5 are symmetrically dispose along two lateral sides of the main rod 3, having upper ends that are hingedly connected with the wringing rod 4 and lower ends that respectively pass through the openings 22 and are fastened to the base plate 11 of the cleaning head 1. The two connecting rods 5 are moved upward by pulling up of the wringing rod 4, in turn pulling the cleaning head 1 upward. The transverse bars 56 are respectively mounted on the front and rear parts of the squeezing head 2, each passing through the through holes 25, 26 of the left and right arms 23, 24. The squeezing 57 are respectively set on the two transverse bars 56, leaving a gap in between. When the cleaning element 12 enters the gap between the squeezers 57, water contained therein is squeezed out.

For wringing the cleaning head 1, the user holds main rod 3 with one hand and, with the other hand holding the grip 41, pushes up the wringing rod 4, so that the two connecting rods 5 pull up the base plate 11, taking along the cleaning element 12. The cleaning element 12, having entered the gap between the squeezers 57, is compressed, and water contained therein is squeezed out. After the cleaning element 12 has been wrung, the two connecting rods 5 are pushed down to an original position, in turn pushing down the cleaning element 12 to an original position. Repeated pushing up and down of the wringing rod 4 brings about complete wringing of the cleaning element 12.

Conventional sweeping and wringing apparatuses are convenient and widely used in households. However, the following shortcomings remain:

1. The connecting rods 5 are placed on outer sides, hence easily damage furniture during floor cleaning.

2. Assembling the connecting rods 5 requires much time. Deforming the connecting rods 5 by external force makes the the connecting rods 5 useless.
3. Replacing the cleaning element 12 is inconvenient.

SUMMARY OF THE INVENTION

It is an object of the present invention to provide a connecting assembly for a sweeping and wringing apparatus which is easy to mount and contributes to reduced production cost.

Another object of the present invention is to provide a connecting assembly for a sweeping and wringing apparatus which helps to avoid damaging of furniture during floor sweeping.

A further object of the present invention is to provide a connecting assembly for a sweeping and wringing apparatus which allows for easy replacing of a cleaning head.

The present invention can be more fully understood by reference to the following description and accompanying drawings.

DETAILED DESCRIPTION OF THE PREFERRED EMBODIMENTS

As shown in FIGS. 1–5, the connecting rod assembly of the present invention is used in conjunction with a sweeping and wringing apparatus having a cleaning 1*a* with a base plate 11*a* and a cleaning element 12*a*, a squeezing head 2*a*, a main rod 3*a*, a U-shaped wringing rod 4*a*, and two squeezers 57. The connecting assembly of the present invention comprises a connecting rod 5*a* and a connecting part 6.

The squeezing head 2*a* is placed on an upper side of the cleaning head 1*a*, partly surrounding the cleaning head 1*a* in the shape of the inverted letter U. The squeezing head 2*a* has an upper part with a fastening hole 21 and front and rear holders 23, 24, separately bridging an opening 27. The main rod 3*a* is mounted on the fasting hole 21 of the squeezing head 2*a* and has a lower part an elongated hole 31. The wringing rod 4*a* is on two ends thereof hingedly connected with the main rod 3*a* at a middle section thereof and has an outward-reaching middle section with a grip 4*la*, facilitating pulling up of the wringing rod 4*a*. The connecting rod 5*a* has an upper end hingedly connected with the wringing rod 4*a* close to the ends thereof and lower end that reaches down inside the main rod 3*a*. The connecting part 6 has a upper end hingedly connected with the lower end of the connecting rod 5*a* and a lower end fastened to the cleaning head 1*a* . The squeezers 57 are symmetrically disposed on the squeezing head 2*a* at two sides of the front and rear holders 23, 24, respectively, for wringing the cleaning head 12*a*.

For wringing the cleaning element 12*a*, a user holds the main rod 3*a* with one hand and, with the other hand holding the grip 41*a*, pushes up the wringing rod 4*a*, so that the connecting rod 5*a* pulls up the connecting part 6, taking along the cleaning element 12*a*. The cleaning element 12*a*, having entered the gap between the squeezers 57, is compressed, and water contained therein is squeezed out.

The characteristics of the present invention are, firstly, that the connecting rod 5*a* is placed inside the main rod 3*a* and is hingedly connected with the connecting part 6 and, secondly, that the connecting part 6 is fixed on the cleaning head 1*a*, facilitating replacing of the cleaning head 1*a*.

Referring to FIGS. 4 and 5, the connecting part 6 comprises a joint 61, an extended middle part 63 and a fixing part 65. The extended part 63 has a longitudinal elongated hole 64. Suitable fixing elements 32, like rivets or bolts, fasten the main rod 3*a* on the squeezing head 2*a*, while allowing the connecting part 6 freely to move vertically, guided by the elongated hole 64. Since the connecting part 6 is placed inside the main rod 3*a*, no damaging of furniture during floor sweeping will occur.

As shown in FIG. 6, a connecting part 56 comprises the joint 61, an extended middle part 63*a* and the fixing part 65. The main rod 3*a* is by short screws fixed on the squeezing head 2*a*, allowing the connecting part 6 freely to move vertically.

A comparison between the present invention (FIGS. 1–6) and conventional art (FIGS. 12 and 13) shows that conventional art uses connecting rods of complicated structures, which are not easy to mount and to replace. In contrast thereto, the connecting rod 5*a* has a simple structure and is easily mounted. Assembling and replacing the cleaning head 1*a* is readily done, as well.

As shown in FIG. 7, a fixing part 65*a* has a T-shaped groove 66*a*. The T-shaped groove 66*a* holds a T-shaped projection 13*a* which is attached to the cleaning head 1*a*. Curved depressions 651 in the T-shaped groove 66*a* facilitate insertion without deforming, and reinforcing clasps 652 increase stability. Furthermore, two transverse incisions 653 enclose a localizing block 654, which, when set on a corresponding depression on the T-shaped projection 13*a*, allows precisely to position the fixing part 65*a* thereon.

As shown in FIG. 8, a fixing part 65*b* has a T-shaped groove 66*b*. The T-shaped groove 66*b* holds a T-shaped projection 13*b* on a cleaning head 1*b*.

As shown in FIG. 9, a fixing part 65*c* has a T-shaped projection 66*c*. The T-shaped projection 66*c* holds a T-shaped groove 13*c* on a cleaning head 1*c*.

As shown in FIG. 10, a fixing part 65*d* has a groove 66*d*. The groove 66*d* has lateral walls with holes 67 for fastening the fixing part 65*d* on a cleaning head 1*d* by fixing elements 68, which are screws or bolts.

As shown in FIG. 11, a fixing part 65*e* has a projection 66*e*. The projection 66*e* has transverse holes 69 for fastening the fixing part 65*e* on a cleaning head 1*e* by fixing elements 70, which are screws or bolts.

Figure 1:
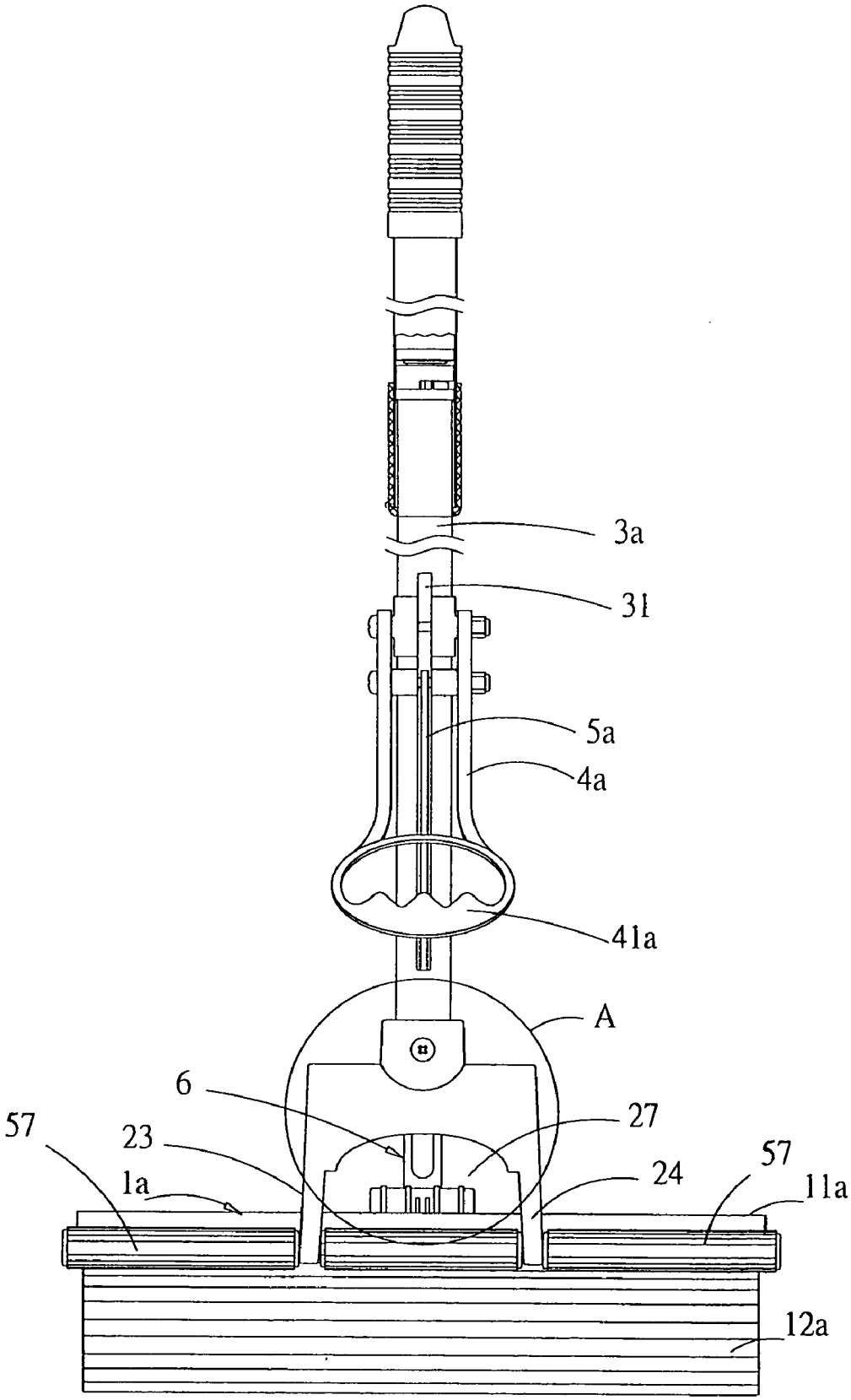
FIG. 1 is a front view of the present invention.
Figure 2:
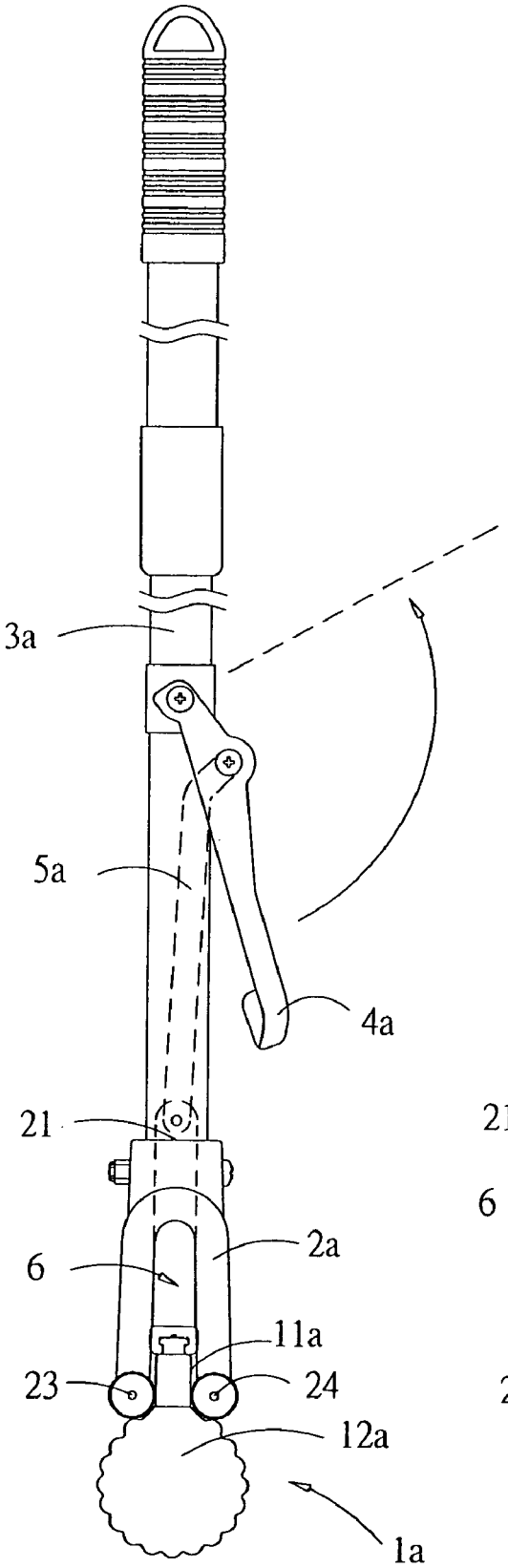
FIG. 2 is a side view of the present invention.
Figure 3:
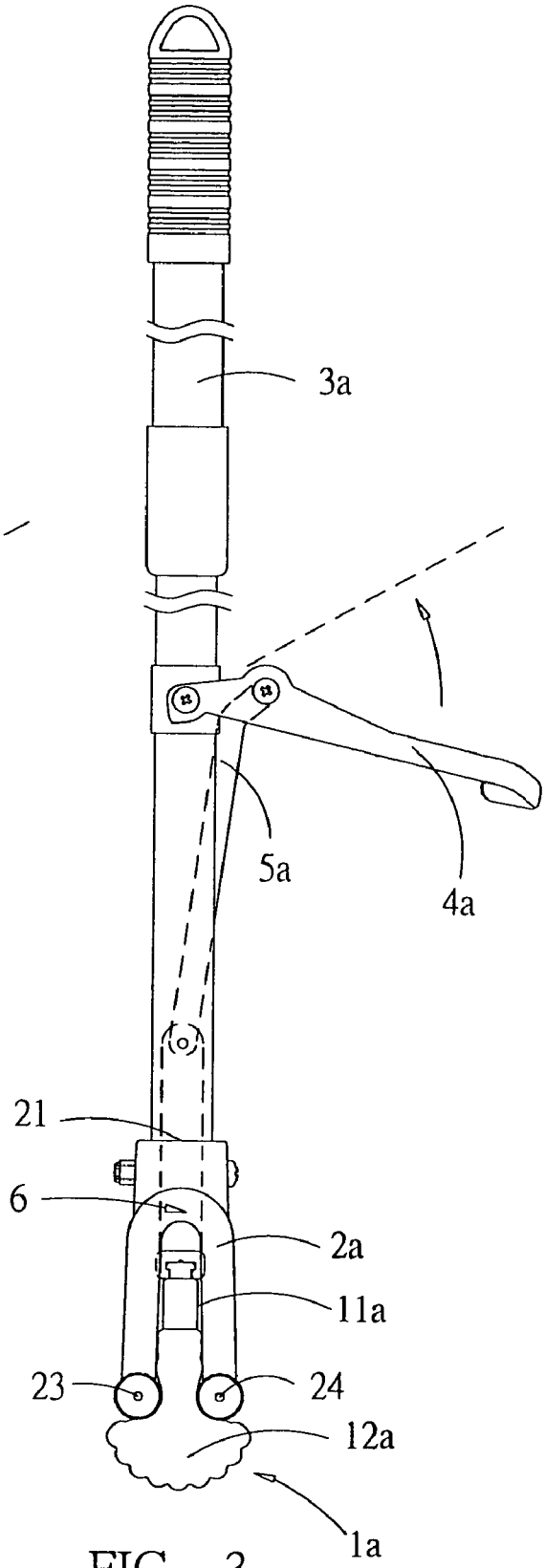
FIG. 3 is a side view of the present invention during the wringing movement.
Figure 4:
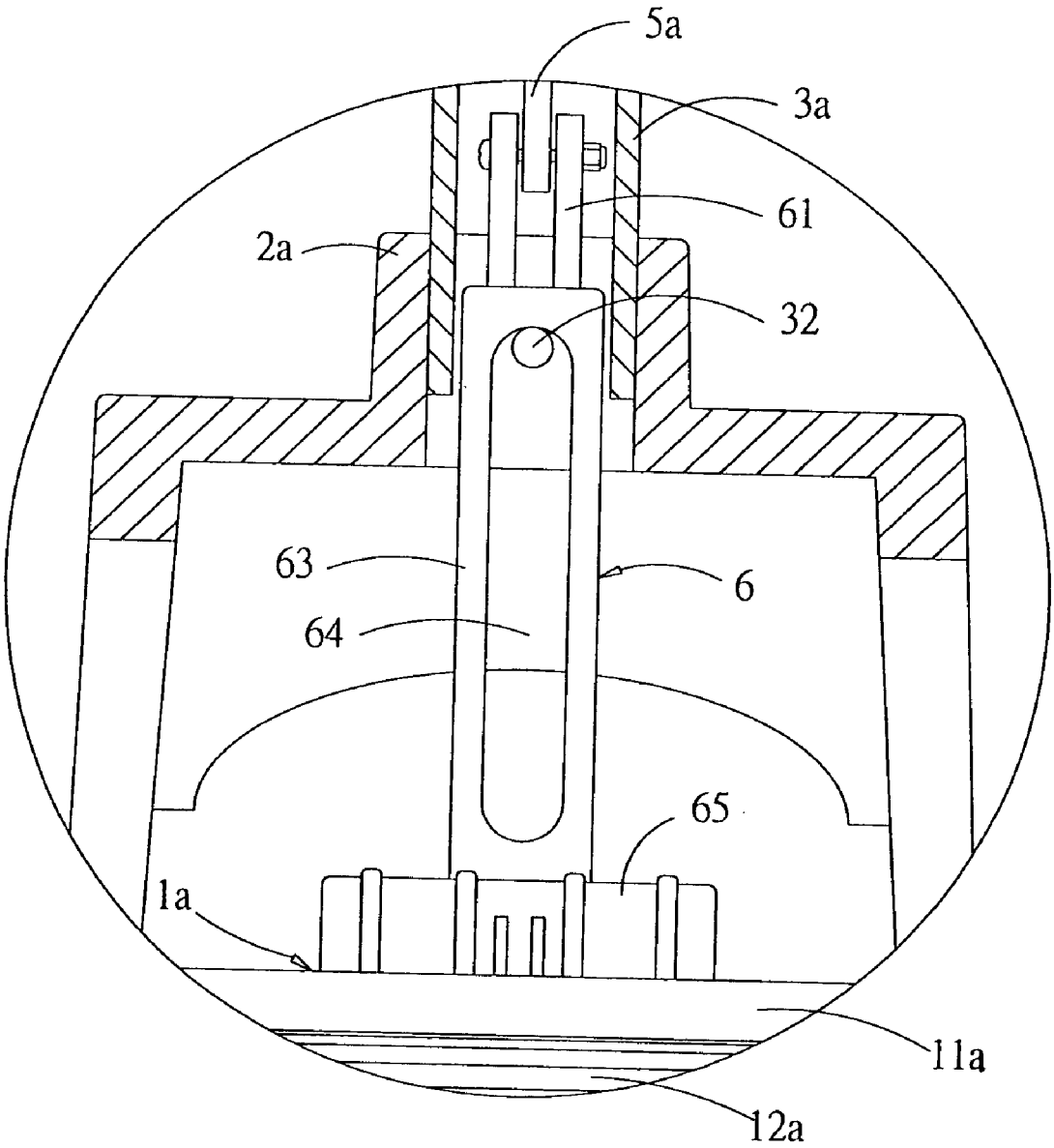
FIG. 4 is an enlarged sectional view of area A of FIG. 1.
Figure 5:
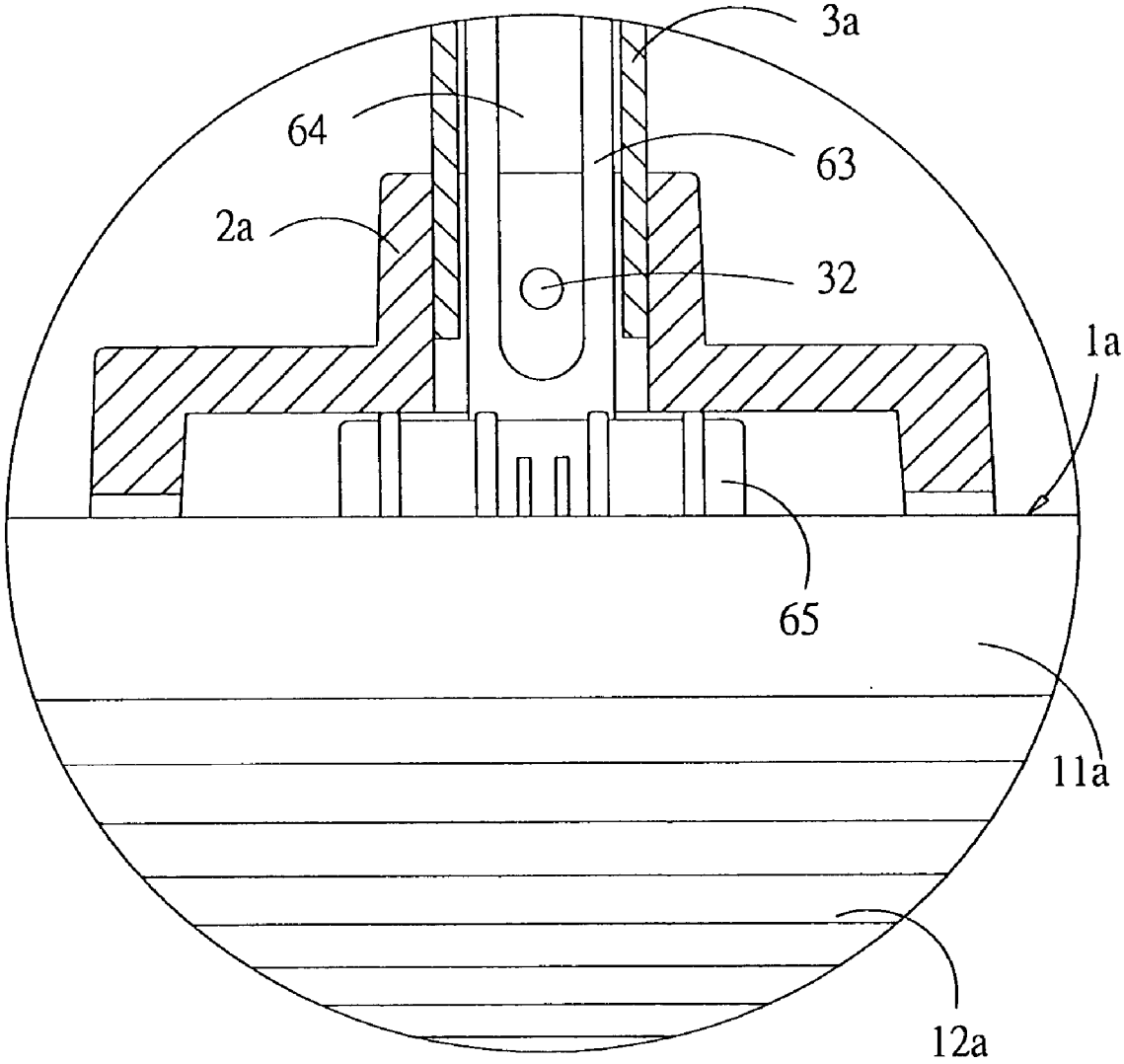
FIG. 5 is an enlarged sectional view of area A of FIG. 1, with the cleaning head pulled up to a highest position.
Figure 6:
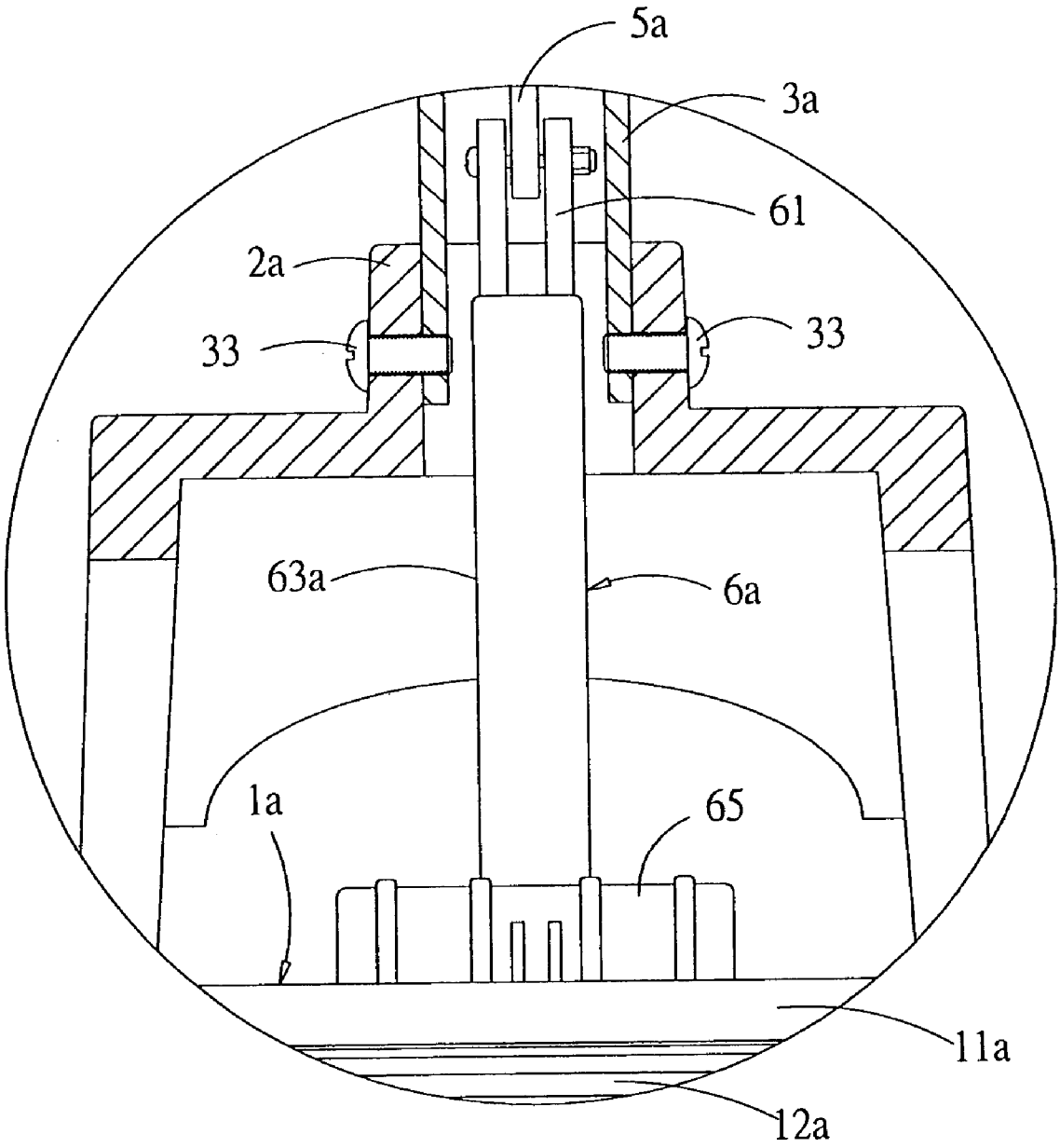
FIG. 6 is an enlarged sectional view of area A of FIG. 1 in another embodiment of the present invention.
Figure 7:
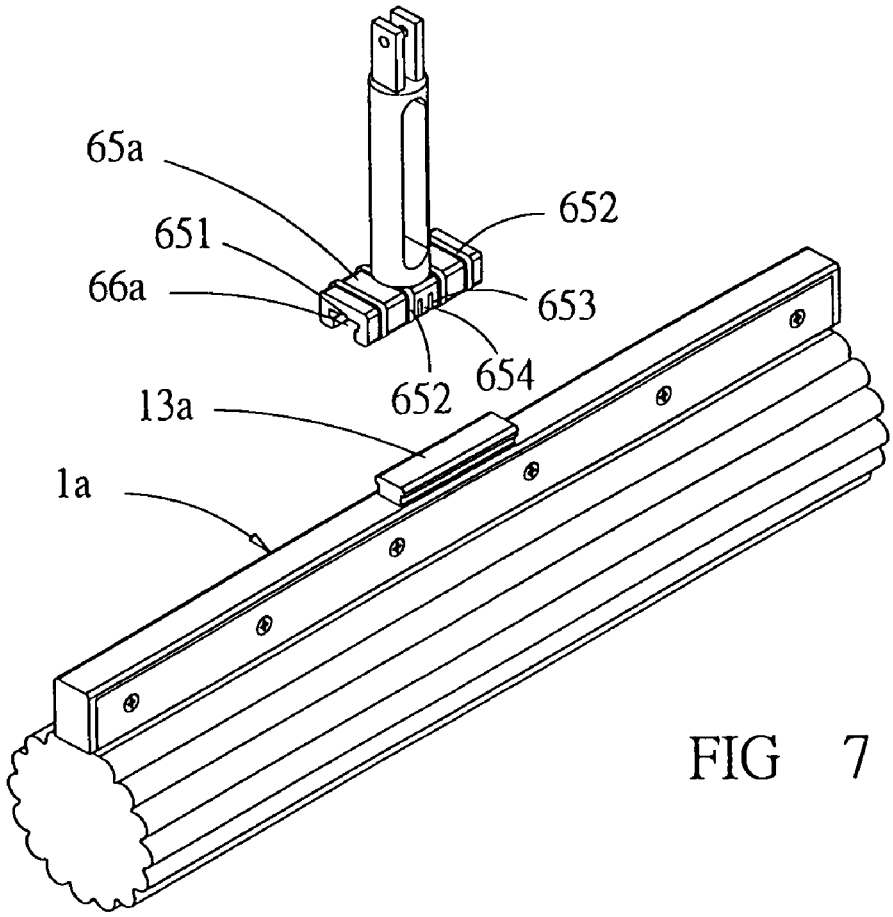
FIGS. 7–11 are perspective views of the connecting part and the cleaning head of the present invention in further embodiments.
Figure 8:
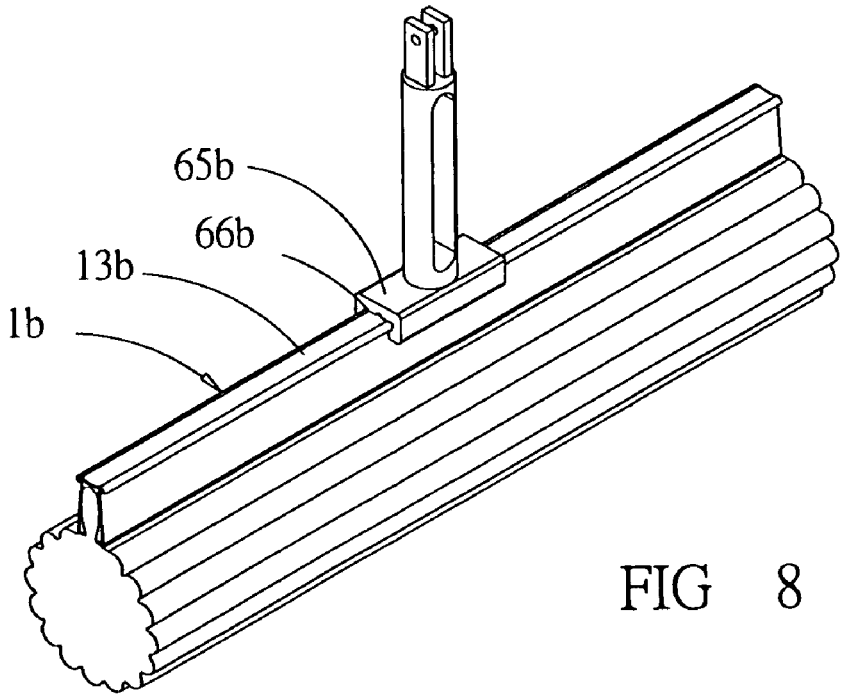
Figure 9:
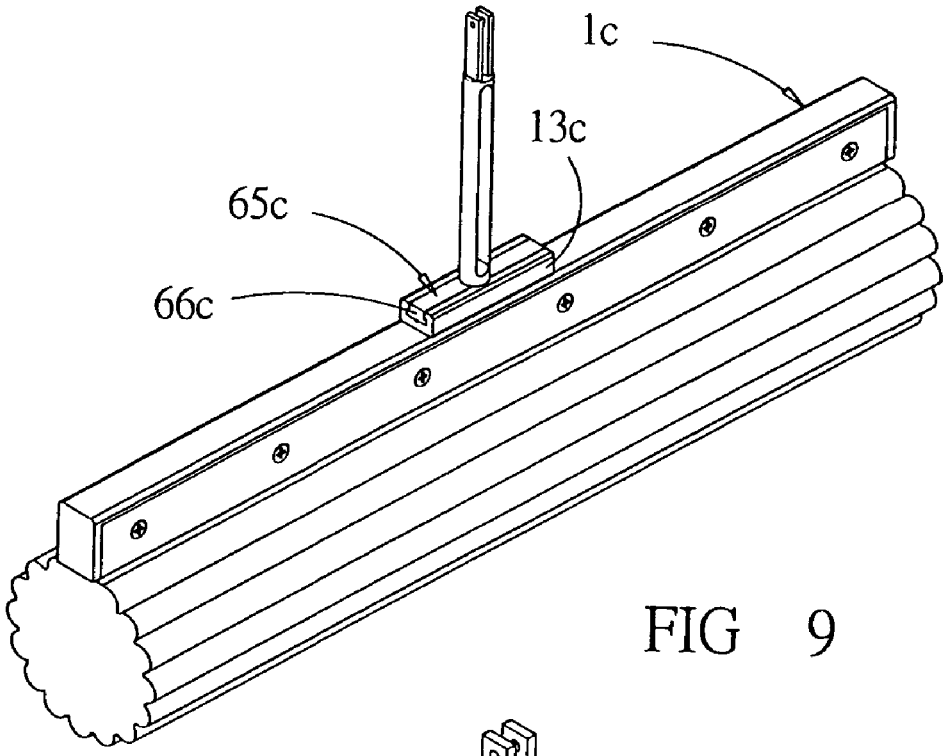
Figure 10:
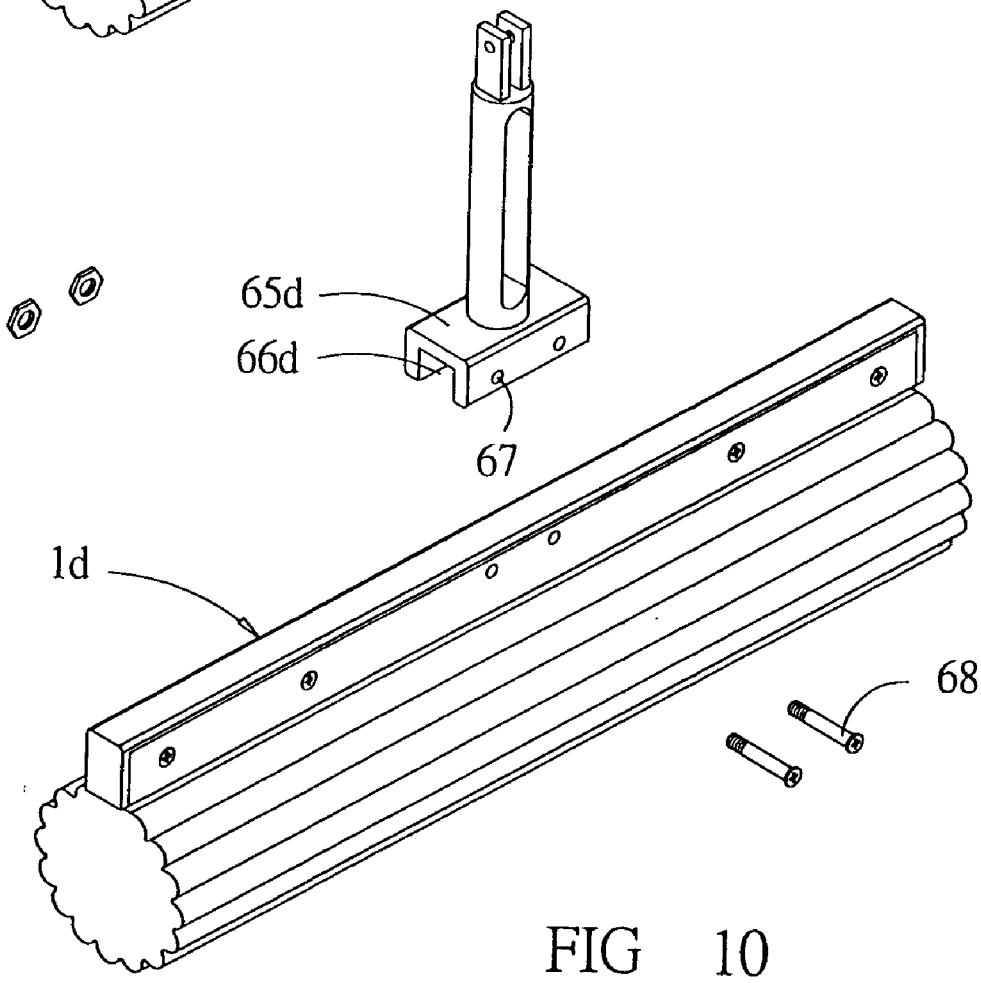
Figure 11:
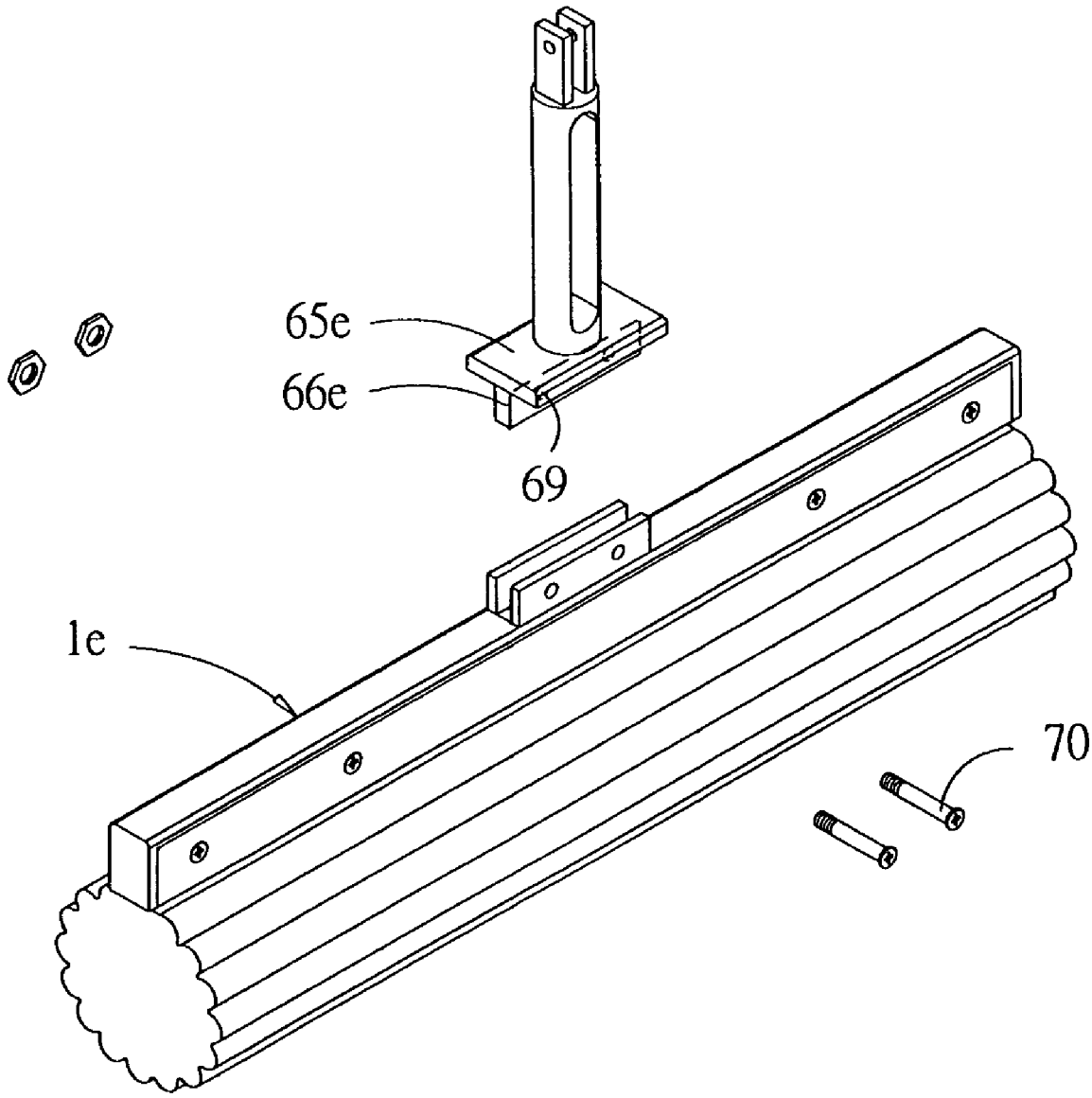
Figure 12:
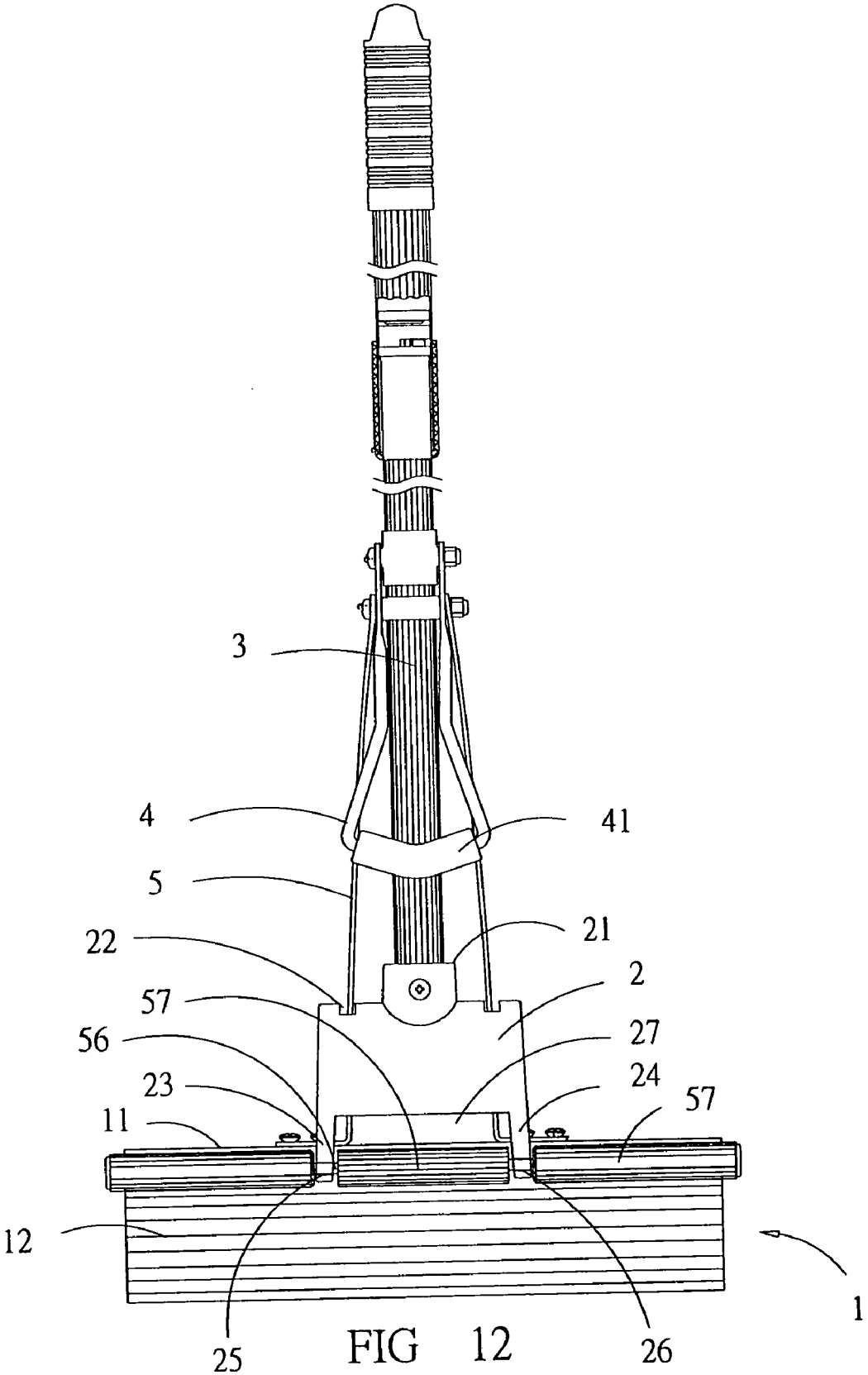
FIG 12 (PRIOR ART)
FIG. 12 (prior art) is a front view of a conventional sweeping and wringing apparatus.
Figure 13:
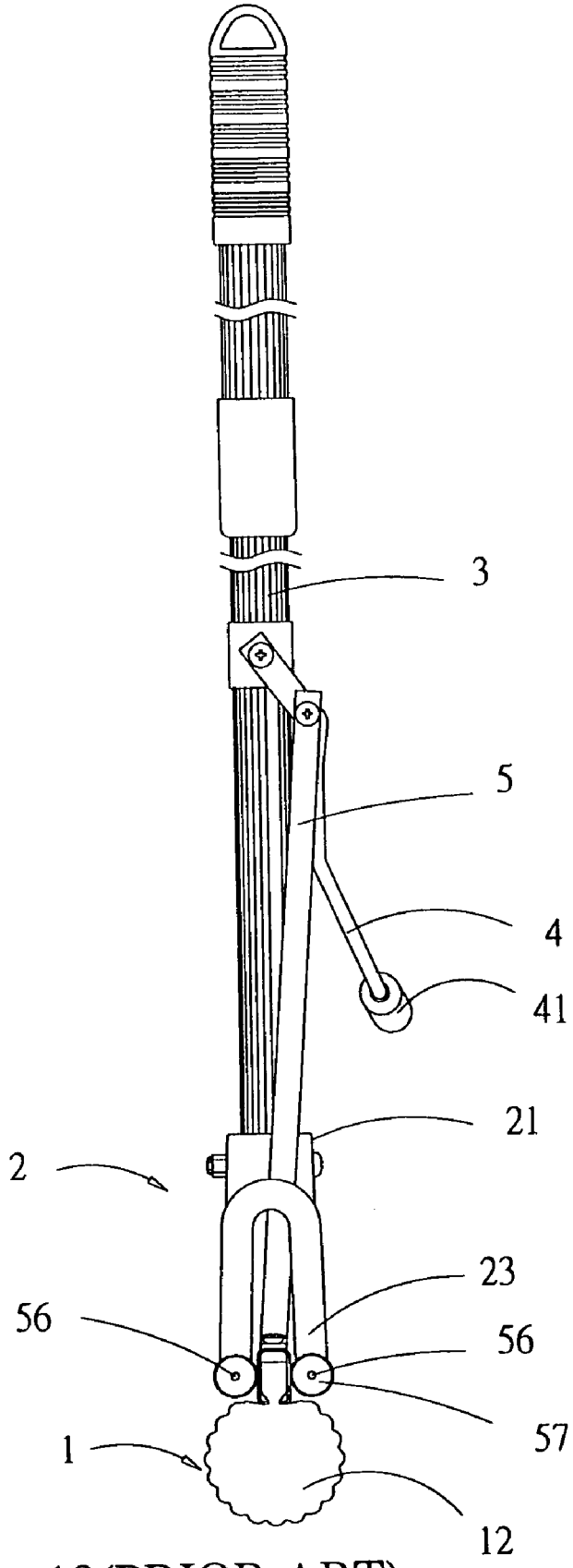
FIG 13(PRIOR ART)
FIG. 13 (prior art) is a side view of a conventional sweeping and wringing apparatus.

The invention claimed is:

1. A connecting assembly for a sweeping and wringing apparatus having a cleaning head, a main rod and a U-shaped wringing rod, said connecting assembly comprising:

a connecting rod, having an upper end that is hingedly connected with said U-shaped wringing rod and a lower end reaching down inside said main rod;

a connecting part, having an upper end with a joint that is hingedly connected with said lower end of said connecting rod, an extended middle part and a fixing part that is fastened to the cleaning head, so that assembling and replacing of said cleaning head are facilitated and damaging of furniture during sweeping is avoided;

wherein said extended middle part of said connecting part has a longitudinal elongated hole; and further wherein said fixing part of said connecting part has a T-shaped groove.

2. A connecting assembly for a sweeping and wringing apparatus having a cleaning head, a main rod and a U-shaped wringing rod, said connecting assembly comprising:

a connecting rod, having an tipper end that is hingedly connected with said U-shaped wringing rod and a lower end reaching down inside said main rod;

a connecting part, having an upper end with a joint that is hingedly connected with said lower end of said connecting rod, an extended middle part and a fixing part that is fastened to the cleaning head, so that assembling and replacing of said cleaning head are facilitated and damaging of furniture during sweeping is avoided;

wherein said extended middle part of said connecting part has a longitudinal elongated hole; and wherein said fixing part of said connecting part has a T-shaped projection.

3. A connecting assembly for a sweeping and wringing apparatus having a cleaning head, a main rod and a U-shaped wringing rod, said connecting assembly comprising:

a connecting rod, having an upper end that is hingedly connected with said U-shaped wringing rod and, a lower end reaching down inside said main rod;

a connecting part, having an upper end with a joint that is hingedly connected with said lower end of said connecting rod, an extended middle part and a fixing part that is fastened to the cleaning head, so that assembling and replacing of said cleaning head are facilitated and damaging of furniture during sweeping is avoided;

wherein said extended middle part of said connecting part has a longitudinal elongated, hole; and wherein said fixing part of said connecting part has at least one projection with transverse holes, adapted to fasten said fixing part on said cleaning head by fixing elements.

* * * * *